US008010027B2

(12) United States Patent
Hodoshima et al.

(10) Patent No.: US 8,010,027 B2
(45) Date of Patent: Aug. 30, 2011

(54) IMAGE FORMING APPARATUS

(75) Inventors: Takashi Hodoshima, Kanagawa (JP); Toshiyuki Andoh, Kanagawa (JP); Seiji Hoshino, Kanagawa (JP); Takashi Hashimoto, Kanagawa (JP); Hidetaka Noguchi, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/461,945

(22) Filed: Aug. 28, 2009

(65) Prior Publication Data

US 2010/0046991 A1 Feb. 25, 2010

(30) Foreign Application Priority Data

Aug. 29, 2008 (JP) ..... 2008-221817

(51) Int. Cl.
*G03G 15/20* (2006.01)

(52) U.S. Cl. ..... 399/313; 399/121

(58) Field of Classification Search ..... 399/121, 399/297, 302, 303, 308, 310, 312, 313
See application file for complete search history.

(56) References Cited

U.S. PATENT DOCUMENTS 6,731,899 B2 * 5/2004 Takahata et al. ..... 399/302
7,398,042 B2 * 7/2008 Seo ..... 399/302

FOREIGN PATENT DOCUMENTS

| | | |
|---|---|---|
| JP | 04-242276 | 8/1992 |
| JP | 2008-040289 | 2/2008 |
| JP | 2008-139749 | 6/2008 |
| JP | 2008-191358 | 8/2008 |
| JP | 2008-262038 | 10/2008 |

OTHER PUBLICATIONS

Office Action dated Feb. 23, 2011 issued in corresponding Chinese Application No. 200910168382.8.

* cited by examiner

*Primary Examiner* — Hoan Tran
(74) *Attorney, Agent, or Firm* — Harness, Dickey & Pierce, P.L.C.

(57) ABSTRACT

An image forming apparatus includes an image transfer belt, a first pressure member, a second pressure member, and an adjustable tension member. The image transfer belt is trained around multiple rollers for rotation along an endless belt travel path to convey an image for transfer to a recording sheet. The first pressure member is disposed on an outer surface of the image transfer belt. The second pressure member is disposed on an inner surface of the image transfer belt opposite the first pressure member. The first and second pressure members define an image transfer gap therebetween. The adjustable tension member is disposed on the image transfer belt adjacent the image transfer gap to adjust tension on the image transfer belt when the recording sheet enters and exits the image transfer gap.

19 Claims, 4 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2008-221817, filed on Aug. 29, 2008, which is hereby incorporated by reference herein in its entirety.

BACKGROUND OF THE INVENTION

1. Field of the Invention

The present invention relates to an image forming apparatus, and more particularly, to an electrophotographic image forming apparatus that uses an image transfer belt to convey an image along an endless loop path for transfer to a recording medium at a transfer gap defined between a pair of pressure members.

2. Discussion of the Background in electrophotographic image forming apparatuses, such as printers, photocopiers, facsimiles, and multifunctional machines incorporating several of these functions, a color image is produced by combining layers of sub-images formed with toner of different primary colors, cyan, magenta, yellow, and black. Currently, most color electrophotographic systems employ a tandem architecture in which multiple drum-shaped photoconductors are arranged in series along an intermediate transfer belt trained around multiple support rollers.

In tandem color printing, each of the photoconductor drums rotates to pass its outer photoconductive surface through a series of various imaging processes to form a sub-image with toner of a particular primary color, while the intermediate transfer belt travels along an endless loop path upon actuation by a drive roller rotating with the belt support rollers.

During rotation along the belt travel path, the intermediate transfer belt passes an imaging portion or area thereof through a series of primary transfer nips defined between the photoconductor drums and corresponding primary transfer rollers. At each primary transfer nip, a sub-image is transferred from the photoconductive surface to the imaging area with a bias voltage applied to the primary transfer roller pressed against the intermediate transfer belt. As the imaging area proceeds from one nip to another to repeat the primary transfer process, sub-images of different colors are superimposed one atop another to form a composite color toner image on the intermediate transfer belt.

After primary transfer, the intermediate transfer belt advances the imaging area to a secondary transfer nip defined between a pair of secondary transfer members, e.g., a pair of pressure rollers opposed to each other. Simultaneously with the imaging area entering the secondary transfer nip, a recording medium, such as a sheet of paper, also enters the secondary transfer nip to meet the toner image on the belt surface. At the secondary transfer nip, the toner image is transferred from the belt surface to the incoming recording sheet with a bias voltage applied across the pair of transfer rollers pressed against each other, one on the belt side and the other on the sheet side. The recording sheet thus bearing the toner image thereon is then forwarded to fixing and/or other finishing processes to complete one cycle of color image formation.

In such a configuration, it is important for good imaging quality of the tandem color printer to maintain a constant process velocity at which the photoconductor drum passes the photoconductive surface through the series of imaging processes. This is particularly true for the primary transfer process, where major variations in the process velocity create irregularly expanded and compressed areas in resulting images, and even minor ones can result in noticeable variations of toner density in solid prints which should be of a single uniform tone or color.

Theoretically, the process velocity during primary transfer is defined as a velocity of the photoconductive surface relative to a velocity of the intermediate transfer belt passing through the primary transfer nip. Provided that the photoconductor drum rotates at a constant speed, maintaining a constant traveling speed of the intermediate transfer belt is required to maintain a constant process velocity during primary transfer.

There are several factors that contribute to causing variations in the traveling speed of an intermediate transfer belt, one of which arises when the tandem printer processes recording sheets thicker than those used for ordinary printing.

That is, when a thick recording sheet enters the secondary transfer nip, the torque or force required to rotate the belt drive roller abruptly increases corresponding to an increase in the load on the pair of secondary transfer rollers drawing the leading edge of the incoming recording sheet therebetween, in turn causing a temporary decrease in the speed of the intermediate transfer belt. Conversely, when a thick recording sheet leaves the secondary transfer nip, the force required to rotate the belt drive roller abruptly decreases corresponding to a decrease in the load on the pair of secondary transfer rollers expelling the trailing edge of the outgoing recording sheet from therebetween, causing a temporary increase in the speed of the intermediate transfer belt.

Such temporary deceleration and acceleration of the intermediate transfer belt occurring at the secondary transfer nip propagates to the primary transfer nips along the looped belt travel path. When the primary transfer process takes place for a subsequent operational cycle simultaneously with the secondary transfer process, this results in imaging failures due to variations in the velocity of the photoconductive surface relative to that of the intermediate transfer belt.

To address this problem, one conventional image forming apparatus uses a gap adjuster to adjust the distance or transfer gap between a transfer belt and a transfer roller according to a thickness of recording sheet in use. Upon detecting that a recording sheet used is thicker than usual, the gap adjuster widens the transfer gap before the sheet is forwarded to the transfer process. This enables the thick recording sheet to enter and exit the transfer gap without unduly interfering with the transfer roller and the transfer belt, thereby preventing abrupt changes in the load on the transfer roller, as well as concomitant variations in the belt speed and resulting image failures during primary transfer.

A drawback of this method is that the effect of gap adjustment is limited by the extent to which the transfer gap may be widened without affecting the proper functioning of the transfer roller. That is, although widening the transfer gap effectively reduces the load on the transfer roller, it simultaneously means a reduction in pressure applied to the recording sheet entering the transfer gap, and too wide a transfer gap can negate the primary function of the transfer roller and the transfer belt. At the same time, as long as the gap adjuster is required to maintain the width of the transfer gap smaller than the thickness of a recording sheet, the conventional method fails to completely eliminate variations in the belt traveling speed due to the use of thick recording sheets.

SUMMARY OF THE INVENTION

Exemplary aspects of the present invention are put forward in view of the above-described circumstances, and provide a novel image forming apparatus.

In one exemplary embodiment, the novel image forming apparatus includes an image transfer belt, a first pressure member, a second pressure member, and an adjustable tension member. The image transfer belt is trained around multiple rollers for rotation along an endless belt travel path to convey an image for transfer to a recording sheet. The first pressure member is disposed on an outer surface of the image transfer belt to advance the recording sheet in the belt travel path. The second pressure member is disposed on an inner surface of the image transfer belt opposite the first pressure member to press against the first pressure member via the image transfer belt. The first and second pressure members define an image transfer gap therebetween at which the image is transferred from the image transfer belt to the incoming recording sheet under pressure. The adjustable tension member is disposed on the image transfer belt adjacent the image transfer gap to adjust tension on the image transfer belt as the recording sheet enters and exits the image transfer gap.

In one exemplary embodiment, the image forming apparatus includes an image transfer belt, a first pressure member, and a second pressure member. The image transfer belt is trained around multiple rollers for rotation along an endless belt travel path to convey an image for transfer to a recording sheet. The first pressure member is disposed on an outer surface of the image transfer belt to advance the recording sheet in the belt travel path. The second pressure member is disposed on an inner surface of the image transfer belt opposite the first pressure member to press against the first pressure member via the image transfer belt. The first and second pressure members define an image transfer gap therebetween at which the image is transferred from the image transfer belt to the recording sheet under pressure. The second pressure member is displaced relative to the first pressure member to adjust tension on the image transfer belt as the recording sheet enters and exits the image transfer gap.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
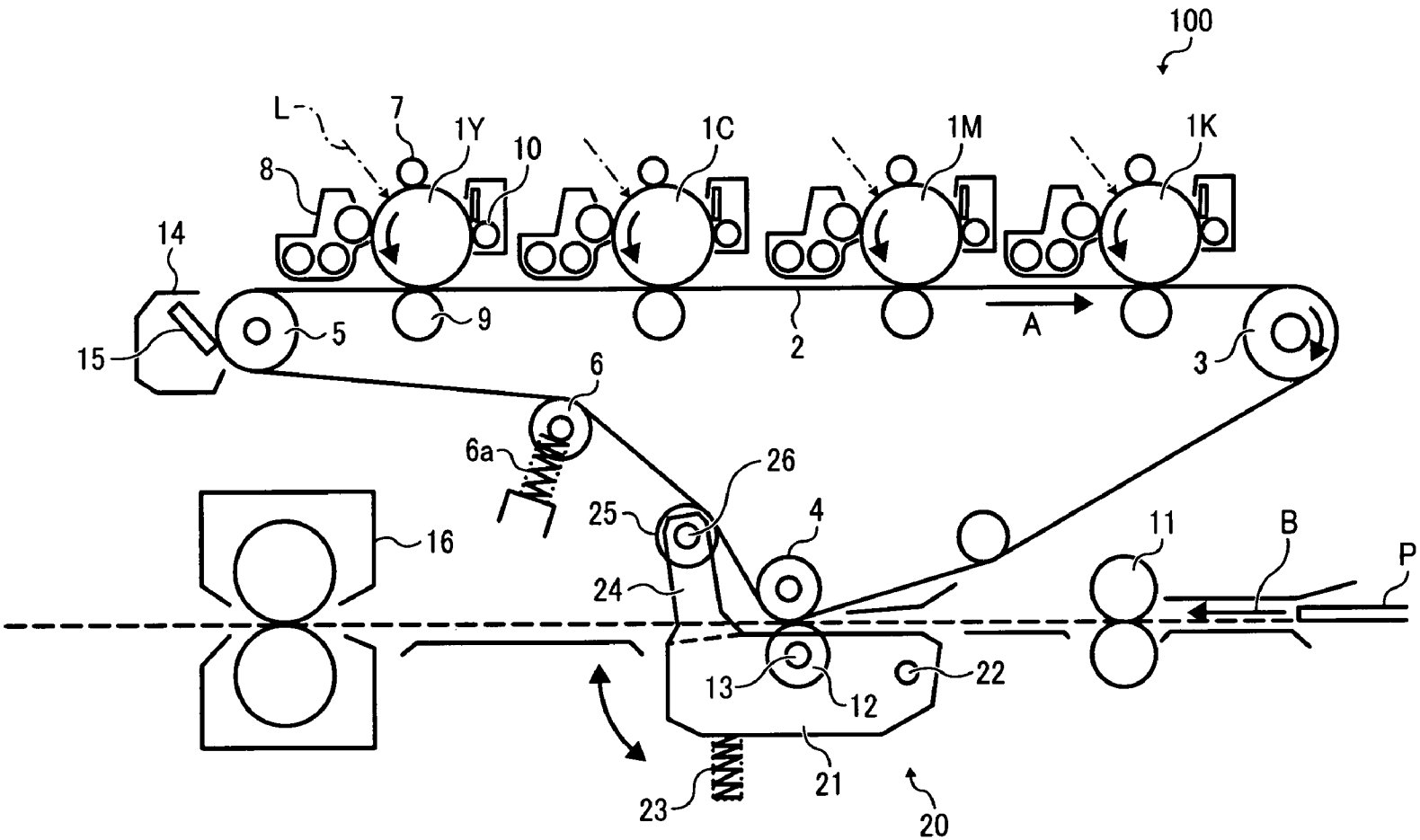
FIG. 1 is a cross-sectional view schematically illustrating an image forming apparatus incorporating an adjustable tension mechanism according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a cross-sectional view schematically illustrating an image forming apparatus 100 according to one embodiment of this patent specification.

As shown in FIG. 1, the image forming apparatus 100 is a tandem color printer with multiple drum-shaped photoconductors 1Y, 1M, 1C, and 1K (collectively designated by the reference numeral 1) arranged in series along the length of an intermediate transfer belt 2.

In the image forming apparatus 100, each photoconductor drum 1 has an outer, photoconductive surface in contact with the intermediate transfer belt 2 and surrounded by various pieces of imaging equipment, such as a charge roller 7, a development device 8, a primary transfer roller 9, and a drum cleaner 10, to form a toner image of a primary color as indicated by the suffix letters, "Y" for yellow, "C" for cyan, "M" for magenta, and "K" for black.

The intermediate transfer belt 2 is trained around multiple support rollers, including a drive roller 3, a backup roller 4, and an end roller 5, of which the former one serves to actuate movement of the intermediate transfer belt 2 and the latter two rotate in accordance with the belt movement actuated. The intermediate transfer belt 2 has its outer surface in contact with a secondary transfer roller 12 rotatable around a rotational axis or shaft 13, a tension roller 6 loaded with a spring 6*a*, and a contact roller 26 rotatable around a rotational axis or shaft 26.

The outer contact rollers 6, 12, and 26, together with the inner support rollers 3 through 5, define an endless loop travel path along which the intermediate transfer belt 2 travels in the direction of arrow A upon actuation by the drive roller 3. Along the belt travel path from upstream to downstream are a series of primary transfer nips defined between the photoconductor drums 1Y, 1C, 1M, and 1K and the corresponding primary transfer rollers 9, a secondary transfer nip defined between the backup roller 4 and the secondary transfer roller 12, and a belt cleaner 14 having a cleaning blade 15 held against the end roller 5 downstream of the secondary transfer nip and upstream of the primary transfer nips.

The image forming apparatus 100 also includes a pair of registration rollers 11 forming a sheet feed path for forwarding a recording medium P, such as a sheet of paper or plastic film, from a sheet feeder to a fixing device 16 through the secondary transfer nip in the direction of arrow B.

As will be described later in more detail, the image forming apparatus 100 according to this patent specification includes an adjustable belt tension mechanism 20, of which the contact roller 26 forms a part, which maintains a constant traveling speed of the intermediate transfer belt 2 by adjusting tension on the intermediate transfer belt 2 in response to an abrupt change in the load of a transfer member caused by a recording sheet P entering or exiting the secondary transfer nip.

During color image formation, each of the photoconductor drums 1 rotates counterclockwise in the drawing to forward its photoconductive surface to a series of imaging processes. Specifically, the photoconductive surface is initially charged to a given potential by the charge roller 7, and then is exposed to a modulated laser beam L emitted from an exposure device, not shown. The exposure to laser beam L forms an electrostatic latent image on the photoconductive surface according to image data of a specific primary color, which is subsequently rendered into a visible toner image by the development device 8. The toner image thus developed is forwarded to the primary transfer nip between the photoconductor drum 1 and the primary transfer roller 9.

On the other hand, as the belt drive roller 3 rotates clockwise in the drawing upon actuation by a rotary motor, not shown, the intermediate transfer belt 2 rotates along the belt travel path to pass an imaging portion or area thereof through the series of primary transfer nips, the secondary transfer nip, and the belt cleaner 14, in that sequence.

At each primary transfer nip, the toner image is transferred from the photoconductive surface to the imaging area with a bias voltage applied to the primary transfer roller 9 pressed against the intermediate transfer belt 2. After primary transfer, the photoconductive surface is cleaned of residual toner by the drum cleaner 10 in preparation for a subsequent imaging cycle, while the imaging area is forwarded to a downstream nip for primary transfer of another toner image, if any. As the imaging area proceeds to repeat the primary transfer process, the toner images of different colors are superimposed one atop another to form a composite color toner image on the intermediate transfer belt 2.

After primary transfer and consequent multicolor image formation, the intermediate transfer belt 2 advances the imaging area toward the secondary transfer nip between the secondary transfer roller 12 and the backup roller 4. Simultaneously with the imaging area entering the secondary transfer nip, the registration rollers 11 advances a recording sheet P toward the secondary transfer nip to meet the toner image on the intermediate transfer belt 2. At the secondary transfer nip, the toner image is transferred from the belt surface to the incoming recording sheet P with a bias voltage applied to the shaft 13 of the secondary transfer roller 12 pressed against the backup roller 4.

Thereafter, the recording sheet P thus bearing the powder toner image thereon is forwarded to the fixing device 13, which fixes the final toner image in place with heat and pressure applied to the incoming sheet P. The intermediate transfer belt 2 advances the imaging area to the belt cleaner 14, which removes residual toner from the belt surface with the cleaning blade 15 to prepare it for a subsequent operational cycle.

In such a configuration, it is important for good imaging quality of the tandem color printer 100 to maintain a constant process velocity at which the photoconductor drum 1 passes the photoconductive surface through the series of imaging processes. This is particularly true for the primary transfer process, where major variations in the process velocity create irregularly expanded and compressed areas in resulting images, and even minor ones can result in noticeable variations of toner density in solid prints which should be of a single uniform tone or color.

Theoretically, the process velocity during primary transfer is defined as a velocity of the photoconductive surface relative to a velocity of the intermediate transfer belt 2 passing through the primary transfer nip. Provided that the photoconductor drum 2 rotates at a constant speed, maintaining a constant traveling speed of the intermediate transfer belt 2 is required to maintain a constant process velocity during primary transfer.

There are several factors that contribute to causing variations in the traveling speed of an intermediate transfer belt, including variations in the operation of the rotary motor and gears imparting driving forces to the drive roller, defects in the drive or driven roller having its center offset from the rotational axis, and variations in thickness of the intermediate transfer belt. Other contributing factors occasionally occur during operation of an image forming apparatus, one of which occurs when the printer processes recording sheets thicker than those used for ordinary printing.

Figure 6A:
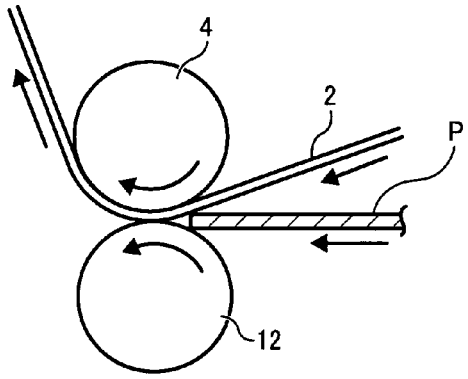
FIGS. 6A and 6B illustrate operation of a pair of rollers opposed through an image transfer belt when a recording sheet enters an image transfer nip defined therebetween.
Figure 6B:
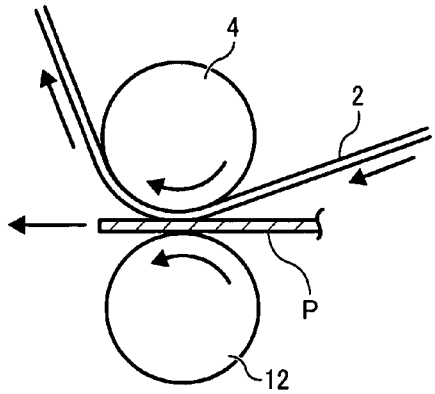

Specifically, as shown in FIGS. 6A and 6B, when a thicker than normal (hereinafter also simply "thick") recording sheet P enters the secondary transfer nip, the torque or force required to rotate the belt drive roller 3 abruptly increases corresponding to an increase in the load on the secondary transfer roller 12 and the backup roller 4 drawing the leading edge of the incoming recording sheet P therebetween, causing a temporary decrease in the speed of the intermediate transfer belt 2.

Figure 7A:
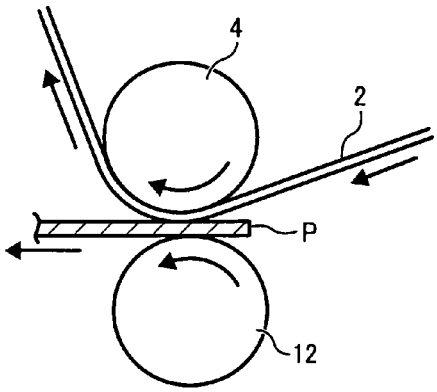
FIGS. 7A and 7B illustrate operation of a pair of rollers opposed through an image transfer belt when a recording sheet exits an image transfer nip defined therebetween.
Figure 7B:
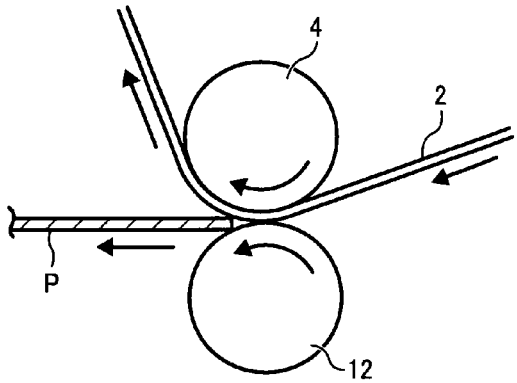

Conversely, as shown in FIGS. 7A and 7B, when a thick recording sheet P leaves the secondary transfer nip, the force required to rotate the belt drive roller 3 abruptly decreases corresponding to a decrease in the load on the secondary transfer roller 12 and the backup roller 4 expelling the trailing edge of the outgoing recording sheet P from therebetween, causing a temporary increase in the speed of the intermediate transfer belt 2.

Such temporary decrease and increase of the belt traveling speed may be considered in terms of driving force transmitted to the intermediate transfer belt at the secondary transfer nip. Referring back to FIG. 1, in the tandem color printer 100, the belt drive roller 3 actuating movement of the intermediate transfer belt 2 imparts a driving force that initially draws the belt 2 through the series of the primary transfer nips to rotate the end roller 5, which in turn draws the belt 2 from the secondary transfer nip to rotate the secondary transfer roller 12 and the backup roller 4.

When a thick recording sheet P enters the secondary transfer nip, it exerts a negative driving force on a portion of the belt 2 passing through the secondary transfer nip, resulting in a temporary decrease in the belt traveling speed. By contrast, when a thick recording sheet P leaves the secondary transfer nip, it exerts a positive driving force on a portion of the belt 2 passing through the secondary transfer nip, resulting in a temporary increase in the belt traveling speed.

In a conventional tandem color printer, a fluctuation in the belt traveling speed occurring at the secondary transfer nip propagates to the primary transfer nips along the looped belt travel path. In other words, a local driving force exerted on the belt at the secondary transfer nip is transmitted to other portions of the belt as well as to the belt drive roller in a direction opposite that of a driving force imparted by the belt drive roller.

When the primary transfer process takes place for a subsequent operational cycle simultaneously with the secondary transfer process, deceleration or acceleration of the traveling belt results in imaging failures due to variations in the velocity of the photoconductive surface relative to that of the intermediate transfer belt. The severity of such effects may depend on the configuration and operating conditions of the secondary transfer process. In general, using paper sheets weighing 100 kilograms or more in terms of weight per thousand pieces can be detrimental to the performance of a conventional tandem color printer.

According to this patent specification, the image forming apparatus 100 incorporates the adjustable tension mechanism 20 for the intermediate transfer belt 100, which counteracts the effects of fluctuations in the belt traveling speed by immediately absorbing a negative or positive driving force exerted on the intermediate transfer belt 2 when a thick recording sheet passes through the secondary transfer nip.

Figure 2:
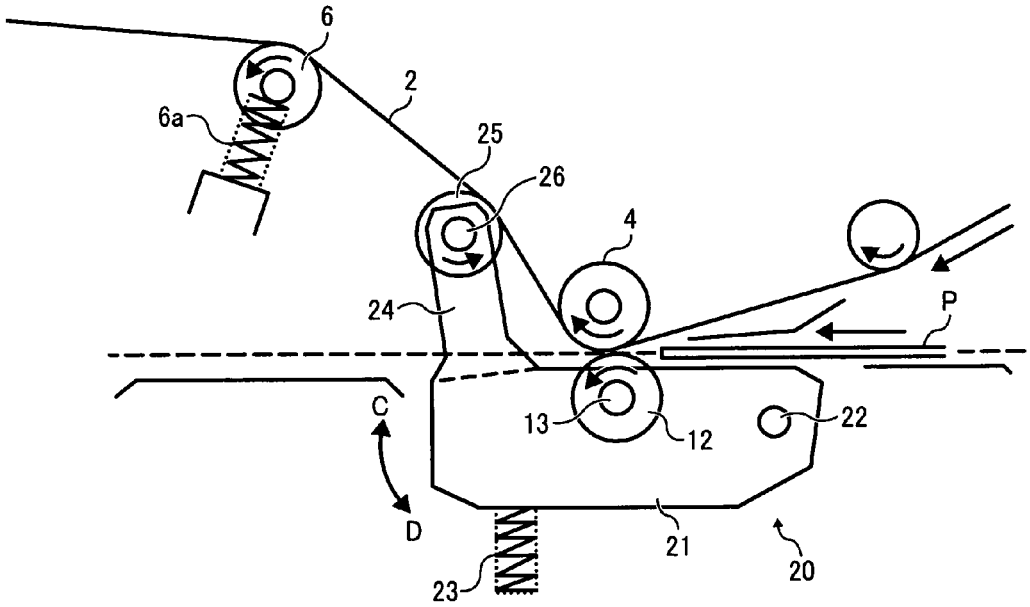
FIGS. 2 and 3 schematically illustrate in detail the adjustable tension mechanism incorporated in the image forming apparatus of FIG. 1.
Figure 3:
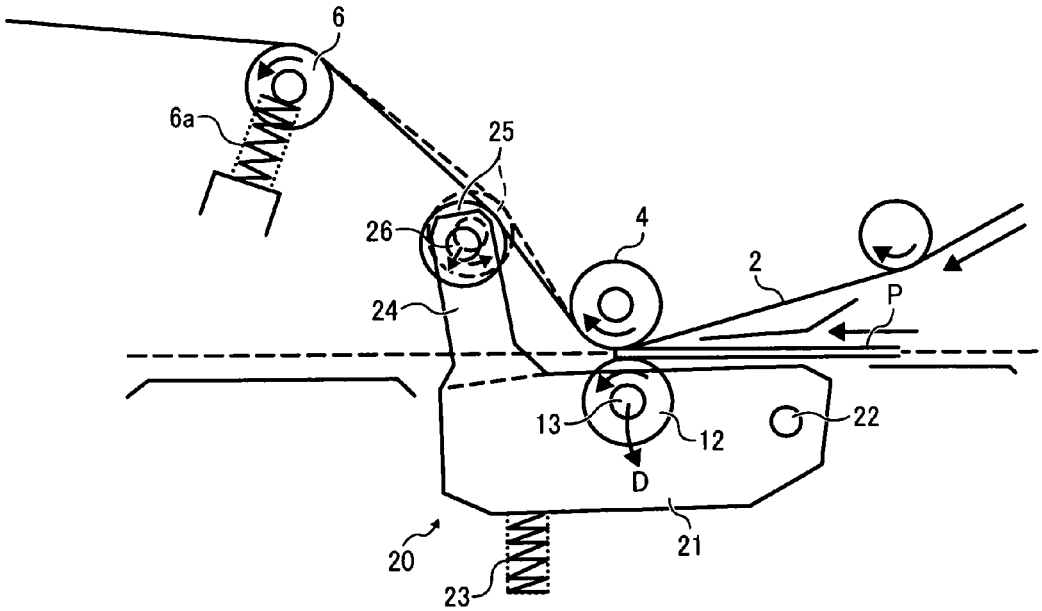

FIGS. 2 and 3 schematically illustrate in detail the adjustable tension mechanism 20 incorporated in the image forming apparatus 100.

As shown in FIGS. 2 and 3, the adjustable tension mechanism 20 has a support frame 21 holding the secondary transfer roller 12 rotatably around the rotational axis 13, and a support arm 24 integral with and extending upward from the support frame 21 to hold the contact roller 25 rotatably around the rotational axis 26 at the upper end of the support frame 21.

On a side opposite to the support arm 24 is a pivot axis 22 around which the support frame 21 is pivotable as indicated by a bi-directional semicircular arrow C-D in FIG. 2. The support frame 21 is forced in the upward direction C with a bias spring 23 so as to press the secondary transfer roller 12 against the backup roller 4 at the secondary transfer nip, and the contact roller 25 against the intermediate transfer belt 2 downstream of the secondary transfer nip and upstream of the tension roller 6.

During operation, the adjustable tension mechanism 20 moves the contact roller 25 between a first protruded position and a second retracted position against the pressure of the bias spring 23, in coordination with the secondary transfer roller 12 alternately and respectively moving away from and toward the intermediate transfer belt 2 as a recording sheet P passes through the secondary transfer nip.

Specifically, while the secondary transfer roller 12 and the backup roller 2 have no recording sheet therebetween, the secondary transfer roller 12 rests in direct contact with the intermediate transfer belt 2, and the contact roller 25 is in the first position protruded against the intermediate transfer belt 2 (FIG. 2).

When the recording sheet P enters the secondary transfer nip, the secondary transfer roller 12 is displaced by an amount d1, not shown, with its rotational axis 13 moving around the pivot axis 22 in the downward direction D. Simultaneously, the contact roller 25 retracts to the second position by an amount d2, not shown, with its rotational axis 26 moving around the pivot axis 22 in the downward direction D, while maintaining direct contact with the intermediate transfer belt 2 (FIG. 3).

With the contact roller 25 thus in the retracted position, the belt travel path differs in length from that defined when the contact roller 25 rests in the protruded position. This reduces tension on the intermediate transfer belt 2 by a certain degree downstream of the secondary transfer nip, which cancels out a negative driving force on the intermediate transfer belt 2 upon entry of a thick recording sheet into the secondary transfer nip, and prevents a temporary decrease in the belt traveling speed from propagating to the primary transfer nips.

Slightly after retraction of the contact roller 25, the spring-loaded tension roller 6 protrudes to restore the original length of the belt travel path as well as the proper tension of the intermediate transfer belt 2, which would otherwise remain loose as long as the contact roller 25 remains in the retracted position during passage of the recording sheet P through the secondary transfer nip. The time lag between retraction of the contact roller 25 and protrusion of the tension roller 6 ensures that the adjustable tension mechanism 20 properly cancels out a negative driving force exerted on the intermediate transfer belt 2 before the tension roller 6 corrects looseness of the intermediate transfer belt 2.

When the recording sheet P exits the secondary transfer nip, the secondary transfer roller 12 returns to the original position with its rotational axis 13 moving around the pivot axis 22 in the upward direction C. Simultaneously, the contact roller 25 returns to the first position with its rotational axis 26 moving around the pivot axis 22 in the upward direction C. This increases tension on the intermediate transfer belt 2 by a certain degree downstream of the secondary transfer nip, which cancels out a positive driving force exerted on the intermediate transfer belt 2 upon exit of a thick recording sheet from the secondary transfer nip, and prevents a temporary increase in the belt traveling speed from propagating to the primary transfer nips.

In the adjustable tension mechanism 20 described above, the amount of retraction d2 of the contact roller 25 is determined by the amount of displacement d1 of the secondary transfer roller 12, as well as by a ratio of a distance D2, not shown, between the contact roller axis 26 and the pivot axis 22 to a distance D1, not shown, between the secondary transfer roller axis 13 and the pivot axis 22. The amount of displacement d1 is substantially equal to the thickness of a recording sheet P in use, and the ratio between D2 and D1 is not so large a number in a typical architecture of the image forming apparatus 100. Accordingly, the amount of retraction d2 of the contact roller 25 is not so great, but is sufficient to prevent propagation of temporary deceleration and acceleration of the intermediate transfer belt 2.

Additionally, the amount of retraction d2 may be set up by specifying the second determining factor D2:D1 (e.g., adjusting the distance D2 between the contact roller axis 26 and the pivot axis 22) in the adjustable tension mechanism 20, which allows for optimizing operation of the contact roller 25 in accordance with the specific configuration of the secondary transfer process on which the degree of deceleration or acceleration of the intermediate transfer belt 2 depends. On the other hand, the first determining factor d1 is substantially proportional to the thickness of a recording sheet entering the secondary transfer nip, which enables the contact roller 25 to adjust the amount of retraction d2 in accordance with varying thickness of recording sheets used in the image forming apparatus 100.

In the embodiment described in FIGS. 1 through 3, the adjustable tension mechanism 20 changes tension on the intermediate transfer belt 2 with the contact roller 25 disposed in contact with the outer belt surface downstream of the secondary transfer nip. Linking the contact roller 25 and the secondary transfer roller 12 to the common pivotable frame 21 enables the contact roller 25 to move coordinately with the secondary transfer roller 12 having the rotational axis 13 displaceable with respect to the fixed rotational axis of the backup roller 4. This configuration enables the adjustable tension mechanism 20 to immediately react to an abrupt change in the belt traveling speed, which occurs within an extremely short period of time (on the order of milliseconds) upon entry and exit of a thick recording sheet to and from the secondary transfer nip.

In further embodiments, it is possible to configure the contact roller 25 to move coordinately with the backup roller 4 instead of the secondary transfer roller 12, where the backup roller 4 has a displaceable rotational axis and the secondary transfer roller 25 has a stationary rotational axis. It is also possible to dispose the contact roller 25 in contact with the inner surface instead of the outer surface of the intermediate transfer belt 2, particularly in configurations where the contact roller 25 moves coordinately with the backup roller 4 having the rotational axis displaceable with respect to the fixed rotational axis of the secondary transfer roller 4. Nevertheless, disposing the contact roller 25 on the outer belt surface is preferable where the intermediate transfer belt 2 has no image on the outer surface when brought into contact with the contact roller 25 downstream the secondary transfer nip, since it allows ready removal and installation of the roller 25 and its surrounding components during maintenance of the image forming apparatus 100.

Moreover, instead of the support arm 24 integral with the support frame 21 linking the contact roller 25 to the secondary transfer roller 12, it is possible to use a precisely regulated, linking mechanism separate from the support frame 21 to establish coordinated movement between the contact roller 12 and the secondary transfer roller 12. Using such a separate linking mechanism increases flexibility in designing the intermediate transfer belt and other components involved in the secondary transfer process, which allows for a compact design of the image forming apparatus 100 with the contact roller 25 disposed remote from the secondary transfer nip.

Besides such physical linking mechanism, it is also possible to use a motor or actuator to establish coordinated movement between the contact roller 25 and the secondary transfer roller 12. In such cases, the timing at which the leading/trailing edge of a recording sheet passes the secondary transfer nip is predicted with a sensor disposed in the sheet feed path upstream of the secondary transfer nip, and the actuator moves the contact roller 25 at the predicated timing for simultaneous movement with the secondary transfer roller 12.

Furthermore, although the embodiment of FIGS. 1 through 3 depicts the contact roller 25 disposed downstream of the secondary transfer nip to loosen the belt 2 upon entry of a recording sheet into the secondary transfer nip, and tighten the belt 2 upon exit of a recording sheet from the secondary transfer nip, the position and operation of the contact roller 25 (i.e., whether it is disposed upstream or downstream of the secondary transfer nip, whether it loosens or tightens the intermediate transfer belt in response to a given change, etc.) can be varied according to the specific configuration of the intermediate transfer belt and its associated components.

Figure 4:
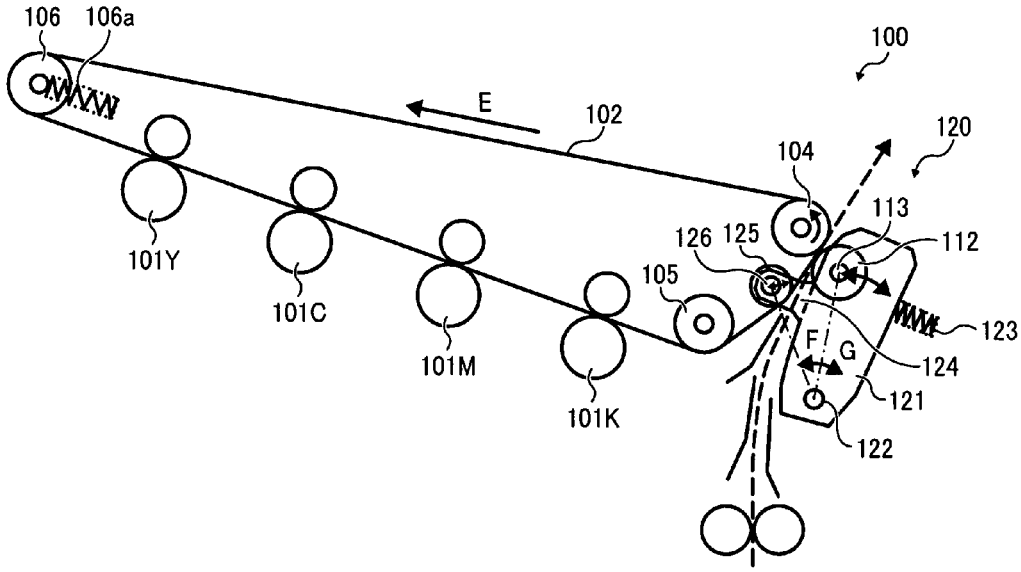
FIG. 4 schematically illustrates the image forming apparatus incorporating an adjustable tension mechanism according to another embodiment of this patent specification.

FIG. 4 schematically illustrates the image forming apparatus 100 incorporating an adjustable tension mechanism 120 according to another embodiment of this patent specification.

As shown in FIG. 4, the image forming apparatus 100 has an intermediate transfer belt 102 trained around a belt drive roller 104, a driven roller 105, a spring-loaded tension roller 106, and a contact roller 125, together defining an endless loop path along which the belt 102 rotates in a direction E when driven by the drive roller 104.

Along the belt travel path from upstream to downstream, the intermediate transfer belt 102 first turns around the tension roller 106, then passes through a series of primary transfer nips defined between photoconductor drums 101Y, 101C, 101M, and 101K and corresponding primary transfer rollers 109, and then turns around the driven roller 105 to finally pass through a secondary transfer nip defined between the drive roller 104 and a secondary transfer roller 112.

In contrast to the configuration described in FIGS. 1 through 3, the secondary transfer roller 112 is opposed to the drive roller 104 imparting driving force to the intermediate transfer belt 102. Thus, entry of a thick recording sheet into the secondary transfer nip increases the load on the drive roller 104 to cause a decrease in driving force imparted by the drive roller 104, resulting in deceleration of the intermediate transfer belt 2. Conversely, exit of a thick recording sheet from the secondary transfer nip decreases the load on the drive roller 104 to cause an increase in driving force imparted by the drive roller 104, resulting in acceleration of the intermediate transfer belt 2.

The adjustable tension mechanism 120 has a support frame 121 holding the secondary transfer roller 112 rotatably around a rotational axis 113, and a support arm 124 integral with and extending from the support frame 121 to hold the contact roller 125 rotatably around a rotational axis 126 at the end thereof.

On one end of the support frame 121 is a pivot axis 122 around which the support frame 121 is pivotable as indicated by a bi-directional semicircular arrow F-G. The support frame 121 is forced in the direction F with a bias spring 123 so as to press the secondary transfer roller 112 against the drive roller 104 at the secondary transfer nip.

In contrast to the contact roller 25 depicted in the embodiment of FIGS. 1 through 3, the contact roller 125 is disposed on the inner surface of the intermediate transfer belt 102 upstream of the secondary transfer nip, where the intermediate transfer belt 102 conveys an image on the outer surface before secondary transfer.

During operation, the adjustable tension mechanism 120 moves the contact roller 125 between a first retracted position and a second protruded position against the pressure of the bias spring 123 in coordination with the secondary transfer roller 112 moving away from and toward the intermediate transfer belt 102 as a recording sheet P passes through the secondary transfer nip.

Specifically, while the secondary transfer roller 112 and the drive roller 104 have no recording sheet therebetween, the secondary transfer roller 112 rests in direct contact with the intermediate transfer belt 102, and the contact roller 125 is in the retracted position. When the recording sheet P enters the secondary transfer nip, the secondary transfer roller 112 is displaced with its rotational axis 113 moving around the pivot axis 122 in the direction G. Simultaneously, the contact roller 125 retracts to the second position with its rotational axis 126 moving around the pivot axis 122 in the downward direction G, while maintaining direct contact with the intermediate transfer belt 102. This increases tension on the intermediate transfer belt 102 by a certain degree upstream of the secondary transfer nip, which cancels out a negative driving force exerted on the intermediate transfer belt 102 upon entry of a thick recording sheet into the secondary transfer nip, and prevents deceleration of the drive roller 104 from propagating to the primary transfer nips.

When the recording sheet P exits the secondary transfer nip, the secondary transfer roller 112 returns to the original position with its rotational axis 113 moving around the pivot axis 122 in the direction F. Simultaneously, the contact roller 125 returns to the first position with its rotational axis 126 moving around the pivot axis 122 in the direction F. This decreases tension on the intermediate transfer belt 102 by a certain degree upstream of the secondary transfer nip, which cancels out a negative driving force exerted on the intermediate transfer belt 102 upon exit of a thick recording sheet from the secondary transfer nip, and prevents acceleration of the drive roller 104 from propagating to the primary transfer nips.

Figure 5:
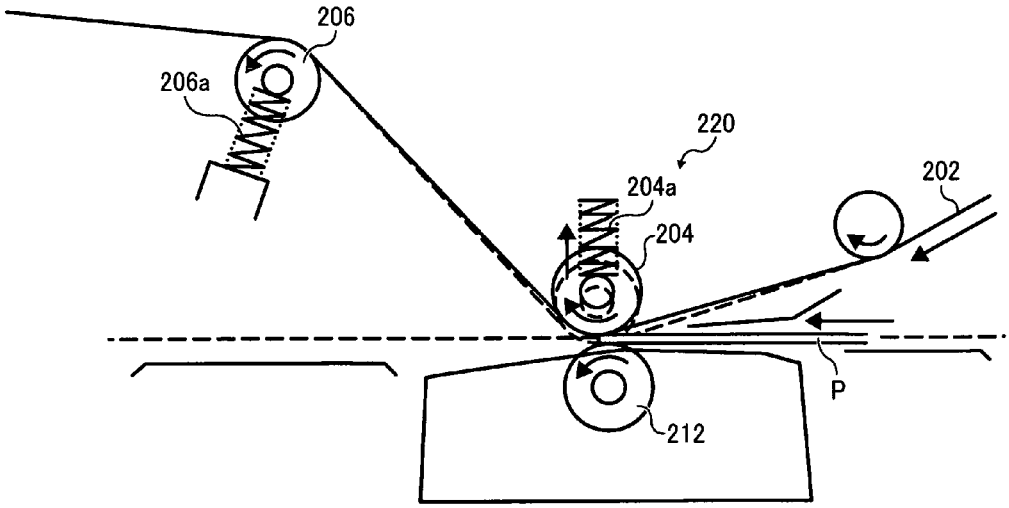
FIG. 5 schematically illustrates the image forming apparatus incorporating an adjustable tension mechanism according to still another embodiment of this patent specification.

FIG. 5 schematically illustrates the image forming apparatus 100 incorporating an adjustable tension mechanism 220 according to still another embodiment of this patent specification.

As shown in FIG. 5, the present embodiment is configured in a manner similar to that depicted in FIGS. 1 through 3, including an intermediate transfer belt 202 driven by a drive roller 203, not shown, a backup roller 204 and a secondary transfer roller 212 defining a secondary transfer nip to pass the rotating belt 202 therethrough, and a spring-loaded tension roller 206 disposed downstream of the secondary transfer nip, except that the adjustable tension mechanism 220 uses no contact roller linked to the secondary transfer roller 212.

Specifically, the adjustable tension mechanism 220 includes a spring 204*a* forcing the backup roller 204 against the secondary transfer roller 212 so as to adjust tension on the intermediate transfer belt 202 upon entry and exit of a recording sheet P to and from the secondary transfer nip.

In such a configuration, when a recording sheet P enters the secondary transfer nip, the backup roller 204 moves away from the secondary transfer roller 212 to decrease tension on the intermediate transfer belt 202. This cancels out a negative driving force exerted on the intermediate transfer belt 202 upon entry of a thick recording sheet into the secondary transfer nip, and prevents a decrease in the belt traveling speed from propagating to the primary transfer nips. When a recording sheet P leaves the secondary transfer nip, the backup roller 204 moves toward the secondary transfer roller 212 to increase tension on the intermediate transfer belt 202. This cancels out a positive driving force exerted on the intermediate transfer belt 202 upon exit of a thick recording sheet from the secondary transfer nip, and prevents an increase in the belt traveling speed from propagating to the primary transfer nips.

In the embodiment described in FIG. 5, the spring-loaded backup roller 204 functions to adjust tension on the intermediate transfer belt when a recording sheet passes through the secondary transfer nip. Such an embodiment is superior to those described in FIGS. 1 through 4 in that it requires no dedicated roller held in pressure contact with the intermediate transfer belt, allowing for a simple and cost-effective design of the image forming apparatus 100.

The secondary transfer roller 212 may be either displaceable or fixed relative to the backup roller 204, as long as the amount of displacement of the backup roller 204 is sufficient to effect a change in belt tension. Similar to the embodiment described in FIGS. 1 through 3, this embodiment uses the tension roller 206 which maintains the original length of the belt travel path and hence a proper tension of the traveling belt 202 during passage of a thick recording sheet through the secondary transfer nip.

Numerous additional modifications and variations are possible in light of the above teachings. For example, although the embodiments above describe an image forming apparatus having a tandem architecture with a series of four photoconductor drums, the number of photoconductors may be other than that described herein, and the image forming apparatus may be a monochrome printer using an image transfer belt to transfer an image formed by a single photoconductor.

Further, the adjustable tension mechanism according to this patent specification may be applied to any configuration of an image forming apparatus, such as an electrophotographic printer, copier, facsimile, or multifunctional machine incorporating several of these functions, as long as it contains an endless, image transfer belt to convey an image thereon for transfer to another imaging surface.

It is therefore to be understood that, within the scope of the appended claims, the disclosure of this patent specification may be practiced otherwise than as specifically described herein.

What is claimed is:

1. An image forming apparatus, comprising:

an image transfer belt trained around multiple rollers for rotation along an endless belt travel path to convey an image for transfer to a recording sheet;

a first pressure member disposed on an outer surface of the image transfer belt to advance the recording sheet in the endless belt travel path;

a second pressure member disposed on an inner surface of the image transfer belt opposite the first pressure member to press against the first pressure member through the image transfer belt;

the first and second pressure members defining an image transfer gap therebetween at which the image is transferred from the image transfer belt to the incoming recording sheet under pressure; and an adjustable tension member disposed on the image transfer belt adjacent the image transfer gap to adjust tension on the image transfer belt as the recording sheet enters and exits the image transfer gap, wherein the adjustable tension member includes a support frame for holding the first pressure member.

2. The image forming apparatus according to claim 1, wherein the first and second pressure members comprise a pair of opposed rollers, one being a transfer roller rotating in contact with the outer belt surface, and the other being a backup roller rotating in contact with the inner belt surface.

3. The image forming apparatus according to claim 2, wherein the support frame is pivotable to move the displaceably supported roller relative to the other of the pair of opposed rollers; and further includes a linking member to connect the adjustable tension member to the support frame for coordinated movement with the displaceably supported roller upon pivoting of the support frame.

4. The image forming apparatus according to claim 3, wherein the backup roller does not actuate rotation of the image transfer belt, and the adjustable tension member decreases tension on the image transfer belt downstream of the image transfer gap as the recording sheet enters the image transfer gap to move the displaceably supported roller away from the other of the pair of opposed rollers.

5. The image forming apparatus according to claim 4, wherein the adjustable tension member increases tension on the image transfer belt downstream of the image transfer gap as the recording sheet exits the image transfer gap to move the displaceably supported roller toward the other of the pair of opposed rollers.

6. The image forming apparatus according to claim 3, wherein the backup roller actuates rotation of the image transfer belt, and the adjustable tension member increases tension on the image transfer belt upstream of the image transfer gap as the recording sheet enters the image transfer gap to move the displaceably supported roller away from the other of the pair of opposed rollers.

7. The image forming apparatus according to claim 6, wherein the adjustable tension member decreases tension on the image transfer belt upstream of the image transfer gap as the recording sheet exits the image transfer gap to move the displaceably supported roller toward the other of the pair of opposed rollers.

8. The image forming apparatus according to claim 1, wherein the adjustable tension member comprises a contact roller rotating in contact with a surface of the image transfer belt.

9. The image forming apparatus according to claim 1, wherein the support frame includes a support arm extending upwardly thereof to hold a contact roller rotabably around a rotational axis at an upper end of the support frame.

10. The image forming apparatus according to claim 9, wherein the support arm pivots around a pivot axis located on an opposite side of the support arm.

11. The image forming apparatus according to claim 1, wherein the support frame is forced in an upward direction with a bias spring.

12. The image forming apparatus according to claim 1, wherein the bias spring presses the first pressing member against the second pressing member.

13. The image forming apparatus according to claim 12, further comprising a contact roller on a support arm of the support frame, the contact roller presses against an intermediate transfer belt.

14. The image forming apparatus according to claim 13, wherein the adjustable tension mechanism moves the contact roller between a first protruded position and a second retracted position against the pressure of the bias spring.

15. The image forming apparatus according to claim 1, wherein the adjustable tension mechanism changes tension on the image transfer belt with a contact roller disposed in contact with the outer belt surface downstream of the image transfer gap.

16. The image forming apparatus according to claim 1, further comprising a contact roller, the contact roller moves coordinately with the second pressure member.

17. The image forming apparatus according to claim 1, further comprising a contact roller, the contact roller is disposed to be in contact with the inner surface of the image transfer belt.

18. An image forming apparatus, comprising:

an image transfer belt trained around multiple rollers for rotation along an endless belt travel path to convey an image for transfer to a recording sheet;

a first pressure member disposed on an outer surface of the image transfer belt to advance the recording sheet in the endless belt travel path;

a second pressure member disposed on an inner surface of the image transfer belt opposite the first pressure member to press against the first pressure member through the image transfer belt;

the first and second pressure members defining an image transfer gap therebetween at which the image is transferred from the image transfer belt to the incoming recording sheet under pressure; and an adjustable tension member disposed on the image transfer belt adjacent the image transfer gap to adjust tension on the image transfer belt as the recording sheet enters and exits the image transfer gap, wherein the first and second pressure members includes a pair of opposed rollers, one being a transfer roller rotating in contact with the outer belt surface, and the other being a backup roller rotating in contact with the inner belt surface, and a support frame to displaceably support one of the pair of opposed rollers, the frame being pivotable to move the displaceably supported roller relative to the other of the pair of opposed rollers.

19. An image forming apparatus, comprising:

an image transfer belt trained around multiple rollers for rotation along an endless belt travel path to convey an image for transfer to a recording sheet;

a first pressure member disposed on an outer surface of the image transfer belt to advance the recording sheet in the endless belt travel path;

a second pressure member disposed on an inner surface of the image transfer belt opposite the first pressure member to press against the first pressure member through the image transfer belt;

the first and second pressure members defining an image transfer gap therebetween at which the image is transferred from the image transfer belt to the incoming recording sheet under pressure; and an adjustable tension member disposed on the image transfer belt adjacent the image transfer gap to adjust tension on the image transfer belt as the recording sheet enters and exits the image transfer gap, wherein the adjustable tension member includes a contact roller rotating in contact with a surface of the image transfer belt.

* * * * *